US006318717B1

(12) United States Patent
Daboub et al.

(10) Patent No.: US 6,318,717 B1
(45) Date of Patent: Nov. 20, 2001

(54) SINGULATOR FOR DOCUMENT FEEDER

(75) Inventors: Henry A. Daboub, DeSoto; Federico Ayala, Grand Prairie; Brent A. Daboub, Dallas, all of TX (US)

(73) Assignee: National Presort, Inc., Dallas, TX (US)

( * ) Notice: Subject to any disclaimer, the term of this patent is extended or adjusted under 35 U.S.C. 154(b) by 0 days.

(21) Appl. No.: 09/515,425

(22) Filed: Feb. 29, 2000

Related U.S. Application Data

(60) Provisional application No. 60/123,129, filed on Mar. 8, 1999.

(51) Int. Cl.[7] ..... B65H 3/46
(52) U.S. Cl. ..... 271/124; 271/121
(58) Field of Search ..... 271/121, 122, 271/124, 125

(56) References Cited

U.S. PATENT DOCUMENTS 3,210,073 * 10/1965 Godlewski ..... 271/125
3,825,248 7/1974 Friend .
4,522,385 6/1985 Stefansson .
4,884,796 12/1989 Daboub .
5,109,987 5/1992 Daboub et al. .

FOREIGN PATENT DOCUMENTS

2244264 A * 11/1991 (GB) ..... 271/121
2029377 A * 3/1980 (GB) ..... 271/124
7700049 * 7/1978 (NL) ..... 271/122

* cited by examiner

*Primary Examiner*—H. Grant Skaggs
(74) *Attorney, Agent, or Firm*—Drude Faulconer

(57) ABSTRACT

A singulator for feeding documents one at a time onto the transport of a processing machine. The singulator includes a pick-off means and a stripper means for preventing multi-feeds of documents. The stripper means is comprised of two independent stripper assemblies which are mounted one above the other. Each assembly is comprised of an arm which is rotatably mounted to the machine at one end and which has a means at the other end for engaging any multi-fed documents. Each stripper assembly has basically the same structure except the arm of one stripper assembly is shorter than the arm of the other assembly whereby the assemblies contact a multi-fed document at different points.

15 Claims, 5 Drawing Sheets

SINGULATOR FOR DOCUMENT FEEDER

CROSS-REFERENCE TO EARLIER APPLICATION

The present application claims the priority of Provisional Patent Application Serial No. 60/123,129, filed Mar. 8, 1999.

DESCRIPTION

1. Technical Field

The present invention relates to a document feeder and in one aspect relates to a document feeder having a singulator which prevents more than one document from being fed at a time.

2. Background

In recent years, automated equipment has been developed for processing large volumes of documents (e.g. letters, postcards, checks, etc.). For example, equipment is currently available which takes stacks of documents and sorts the documents into individual pockets. The documents are picked off the stack by a singulator which feeds the document a reader (e.g. optical character reader or bar code reader) which reads some indicia on the document (e.g. Zip Code) and generates a signal representative thereof. This signal in turn, is processed by a computer which directs that particular document to a designated sort pocket in a "stacker section" of the equipment.

For such equipment to function at maximum efficiency, the documents must be fed one at a time with "multiple feeds" held to a minimum. That is, if more than one document is picked off by the singulator and fed into the equipment at the same time, numerous problems arise; e.g. jamming, hence possible damaging, of the multi-fed documents, failure to properly process all of the documents, etc. Therefore, the document feeder or singulator for such equipment must be capable of picking-off a single document from a stack and then feeding only that document into the equipment for individual processing.

There are several known singulators which have been proposed for this purpose. Some of these operate continuously to feed a steady supply of single documents through the equipment, e.g. see , U.S. Pat. Nos. 4,030,722 and 4,038,555 while others operate to feed a single document on demand. Probably the most widely used type of singulator used in present day document processors is one having (a) one or more forwardly-driven rollers which engage and advance a single document from the front of a stack of documents and (b) a reverse-driven roller which prevents additional documents from being fed into the equipment along with the single document; e.g. see In U.S. Pat. Nos. 3,825,248, 4,522,385, and 4,884,796.

While these types of singulators have worked well in the past, those skilled in this art will recognize that they can still experience significant multi-feeds problems in sorting certain stacks of documents (e.g. mail such as interspersed postcards, letters, "flats", etc.). That is, it is difficult to maintain the proper adjustment between the forward-driven roller and the reverse-driven roller to guard against multi-feeds when a stack of documents is being sorted wherein the size and/or thickness of the documents in the stack may vary significantly.

Since the feeding of "doubles" or "multi-feeds", even if only occasionally, seriously affects the overall efficiency of the processing/sorting equipment, it is vitally important that the singulator used for such equipment be as near perfect in this respect as possible. Accordingly, it follows that any improvement in the reduction of multi-feeds of documents in equipment of this type can significantly improve the operating efficiency of the equipment.

SUMMARY OF THE INVENTION

The present invention provides a document feeder for a document processing machine. Basically the feeder comprises a deck which includes a magazine for receiving a stack of documents and a pick-off means for picking off the documents one at a time. The pick-off means is comprised of a pick-off roller which is driven in a forward direction to engage the first document of said stack of documents and move said first document towards a transport.

A stripper means is positioned downstream from the pick-off means and engages any additional documents (i.e. multi-feeds) that may be inadvertently pulled off the stack along with the first document to thereby prevent further movement of the additional documents until the first document is delivered to the transport. The stripper means of the present invention is comprised of a first stripper assembly and a second stripper assembly both of which are mounted one above the other for independent rotation about a common vertical pivot point on said deck.

The first stripper assembly is comprises a first arm which, in turn, has a first end rotatably mounted on a shaft positioned at the common pivot point on said deck. The first arm has a means at a second end for engaging and restricting further movement of any additional documents with the single document being fed through the singulator. The second stripper assembly is comprised of basically the same structure as the first stripper assembly except the arm of the second stripper assembly is shorter (e.g. from about ⅛ inch to about ¾ inch) than the arm of the first stripper section. Preferably, the longer-arm assembly is positioned above the shorter-arm assembly.

Both the first and the second stripper assemblies are biased inwardly by a spring or the like towards the documents being fed so that each assembly can independently move outward and adjust to different sizes and/or thickness of documents as they are fed through the singulator. Also, individual dampening means (e.g. dash-pots) are provided for each of the assemblies to dampen the movement of the stripper assemblies as they move inward away from the documents. This alleviates the bouncing action caused when a document engages a respective stripper assembly, thereby maintaining better contact with the documents and resulting in a better stripping action to prevent multi-feeds.

By having the arm of one stripper assembly longer than the arm of the other stripper assembly, the short-arm assembly will contact a multi-fed envelope and slow it down before the envelope is contacted and stopped by the longer-arm assembly. This results in improved "stripping" of potential multi-feeds.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
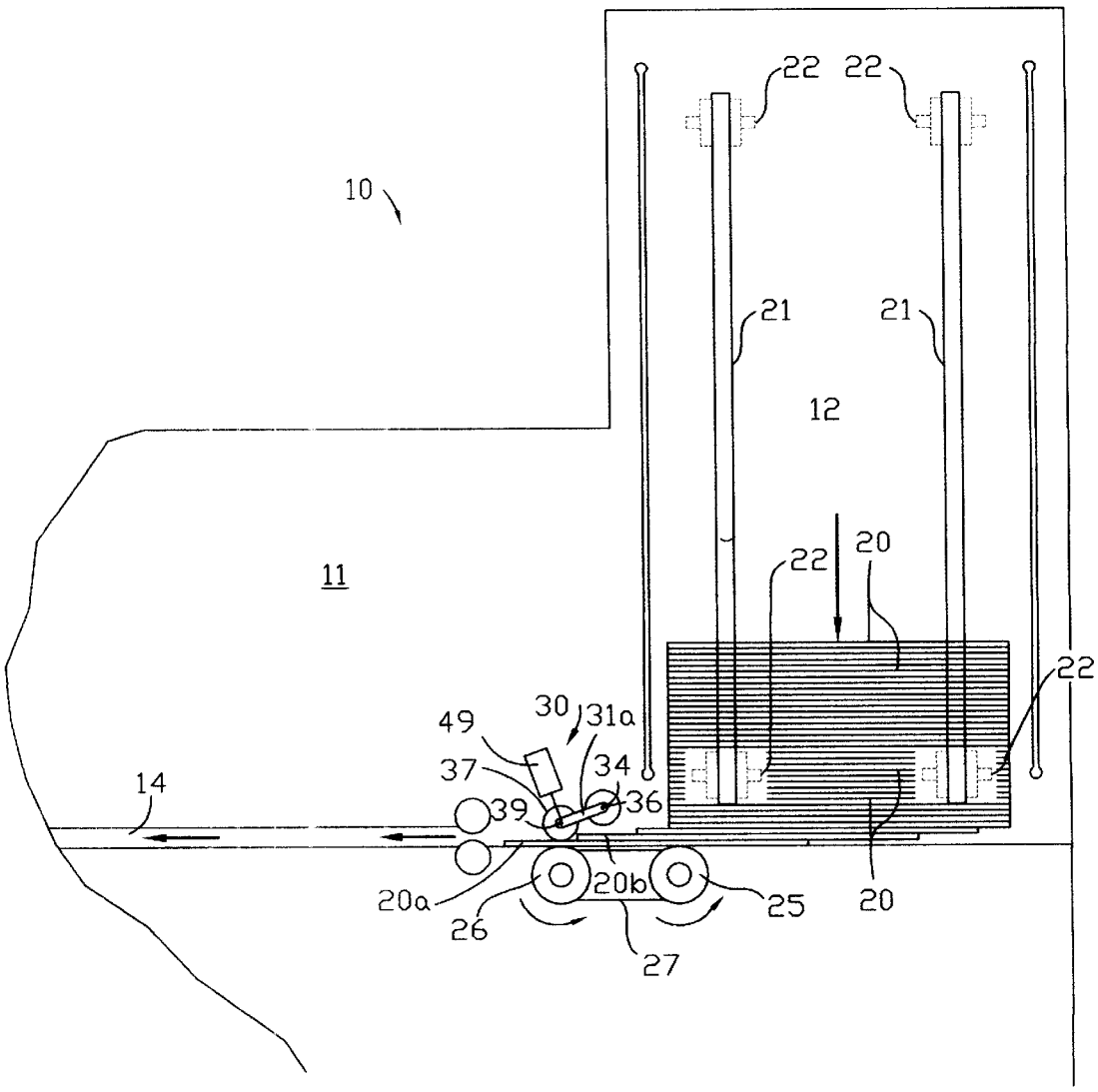
FIG. 1 is a simplified, partial plan view of a document processor incorporating the document feeder of the present invention.

Referring more particularly to the drawings, FIG. 1 is a partial plan view of a typical document processor 10, e.g. a multi-level mail sort machine such as that shown in U.S. Pat. No. 5,109,908, issued May 5, 1992, and which is incorporated herein in its entirety by reference. While described as a document feeder for a mail sort machine, it should be understood that it can used equally as well with other document processing equipment of this general type. As shown, machine 10 is comprised of a deck 11 having a magazine 12 which opens onto transport 14. Magazine 12 is adapted to receive a stack of documents (e.g. envelopes 20) which is moved forward in the magazine by a conveyor (e.g. a pair of continuous belts or chains 21 drivenly-mounted on pulleys 22). As the envelopes 20 are moved forward, they are picked off, one at a time, by singulator 24 and are placed on transport 14 which, in turn, carries the envelopes to their respective destinations; e.g. a designated sort pocket in a stacker section (not shown).

Figure 3:
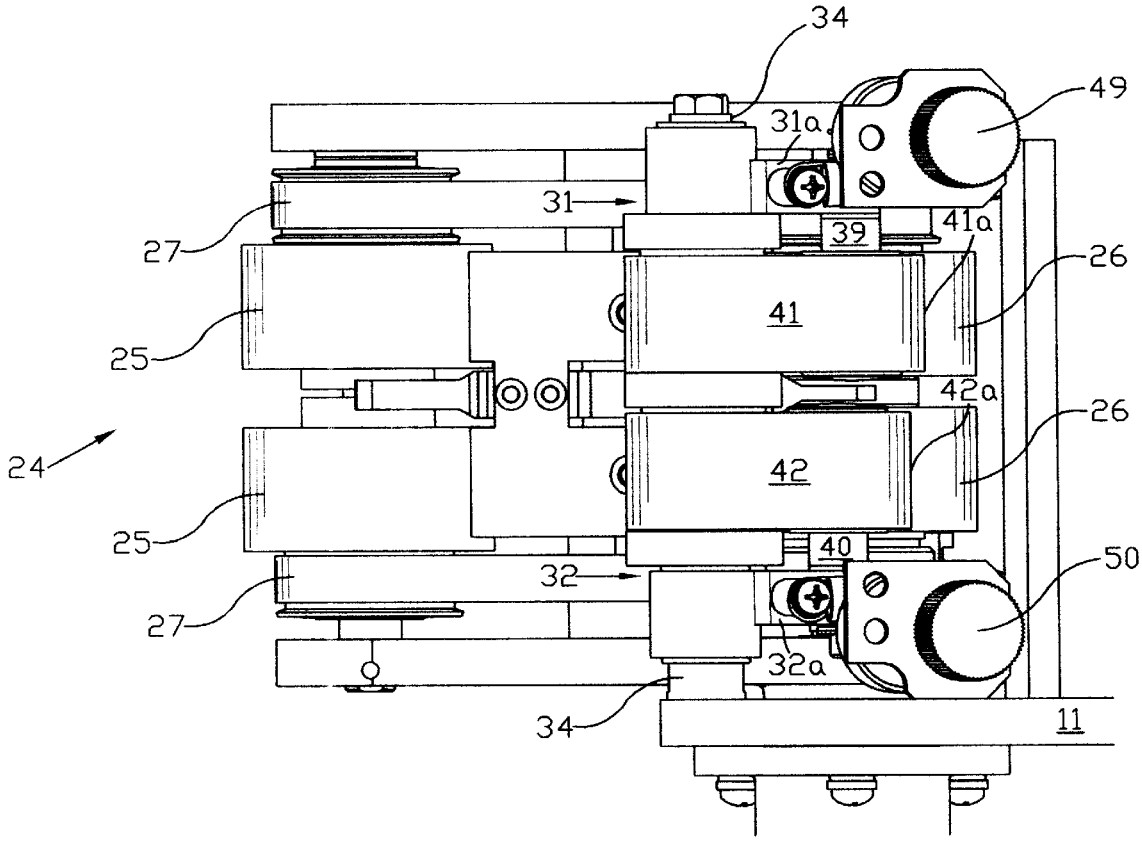
FIG. 3 is an elevation view of the document feeder of FIG. 2.
Figure 4:
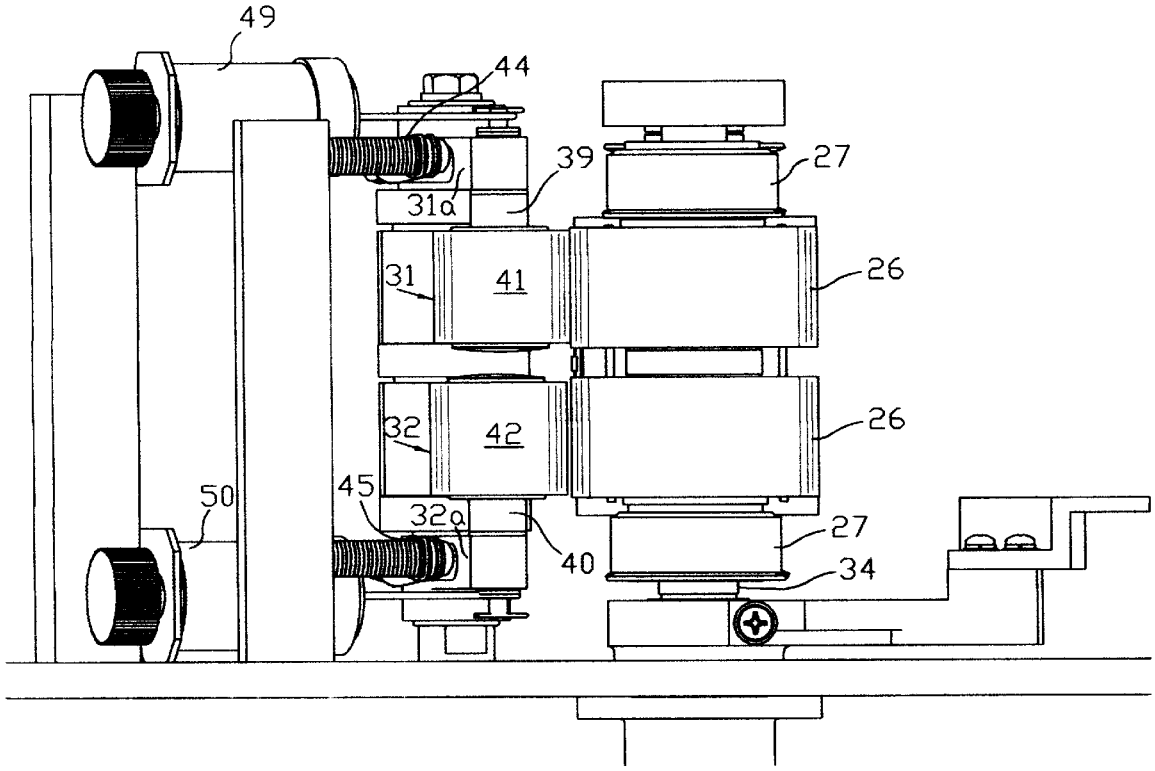
FIG. 4 is a forward end view of the document feeder of FIG. 2.
Figure 5:
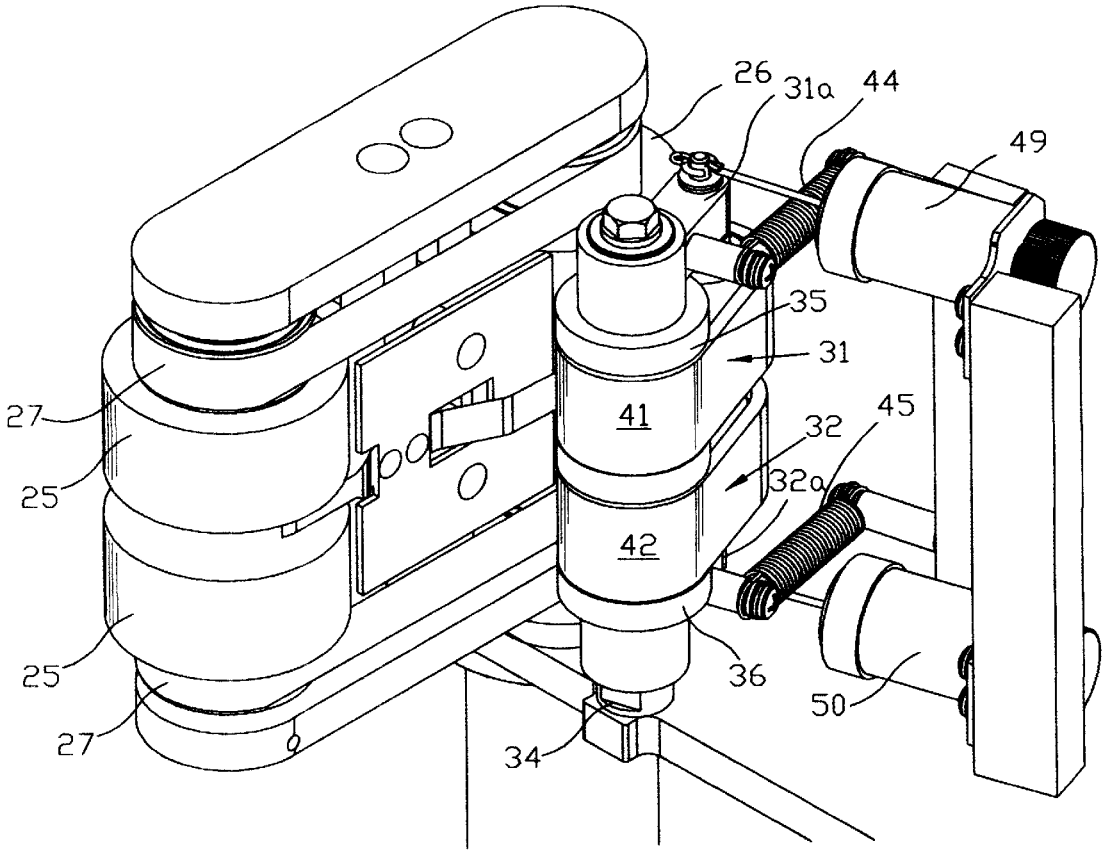
FIG. 5 is a perspective view of the document feeder of FIG. 4.

Singulator 24 of the present invention provides a document feeder which picks off a single envelope (i.e. 20*a* in FIG. 1) from the front of the stack in magazine 18 and delivers it onto transport 14 while physically preventing additional envelopes 20*b* (i.e. multi-feeds) from being fed along with envelope 20*a*. Singulator 24 is basically comprised of a primary pick-off roller(s) 25 which is spaced from and driven by driven roller(s) 26 in a counterclockwise direction (FIG. 1) via belt(s) 27. As seen in FIGS. 3–5, as illustrated, there are two vertically-spaced pick-off rollers 25 mounted on a single shaft and two vertically-spaced driven rollers 26 mounted on a single shaft and two belts 27 therebetween. For more details of this type of pick-off and how it is driven, see U.S. Pat. 4,884,796, issued Dec. 5, 1989, and which is incorporated herein in its entirety by reference.

Pick-off roller(s) 25 picks off envelope 20*a* and advances it into contact with stripper means 30 of the present invention. Stripper means 30 is comprised of two, vertically spaced arms assemblies 31, 32. Each assembly 31, 32 is comprised of an arm 31*a*, 32*a*, respectively, which are freely and independently rotatable at its first end about pivot shaft 34 which, in turn, are fixed on deck 11. Also mounted on shaft 34 at the first ends of arms 31*a*, 32*a*, are idler rollers or pulleys 35, 36, respectively. These rollers are free to rotate on shaft 34 independently of each other.

Stripper rollers 37, 38 are rotatably mounted at the other or second end of arms 31*a*, 32*a*, respectively, about respective shafts 39, 40. Pre-set or adjustable friction clutches (not shown) are positioned between a stripper roller and its respective shaft which will allow the roller to rotate on the shaft if a force is applied to the roller which exceeds a predetermined resistance (e.g. 6 ounces) of the clutches. Idler pulley 35 and stripper roller 37 are drivingly coupled by continuous belt 41 and idler pulley 36 are coupled by belt 42 for a purpose described below.

Figure 2:
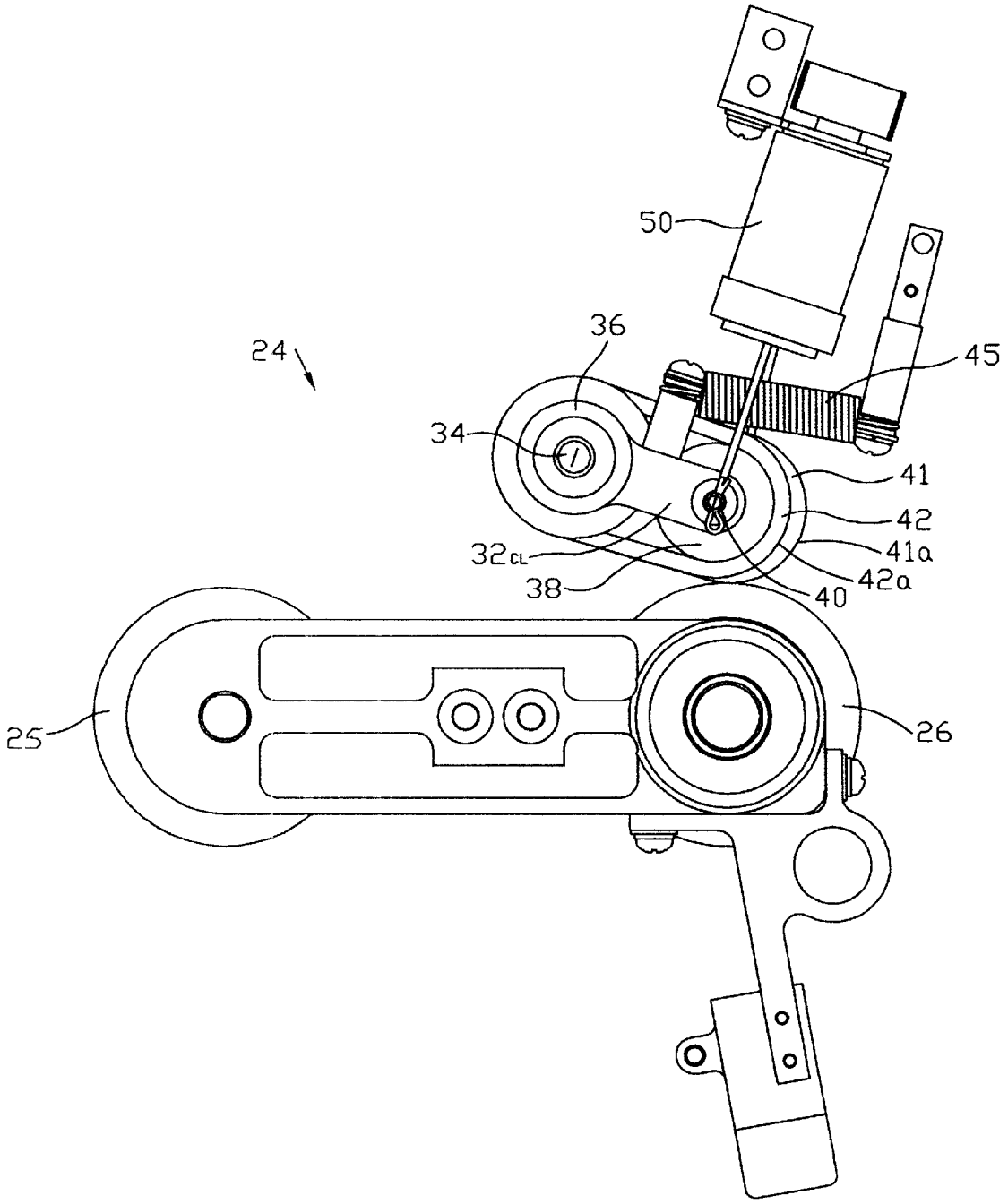
FIG. 2 is a bottom plan view of the document feeder of FIG. 1.

In accordance with a primary feature of the present invention, one of the arms (e.g. top arm 31*a*) is slightly but deliberately longer (e.g. from about ⅛ inch to about ¾ inch; preferably from about ⅛ to about ¼ inch) than the other arm (e.g. bottom arm 32*a*). That is, as best seen in FIGS. 2 and 3, the leading edge 41*a* of belt 41 (hence, length of arm 31*a*) extends a greater distance from pivot shaft 34 than does leading edge 42*a* of belt 42 (hence, length of arm 32).

In operation, a envelope 20*a* is picked off by -off roller 25 and is advanced through the "pinch" formed between driven roller 26 and belts 41, 42 which are positioned onto stripper rollers 37, 38, respectively. Since arm 32*a* is shorter than arm 31*a*, belt 41 on the shorter arm assembly 32 will contact envelope 20*a* first. If only a single envelope is picked off and advanced, driven roller 26 will push the envelope on through both "pinches" formed between driven roller and the respective belts 41, 42. The envelope 20*a* will normally be pushed with sufficient force to move both stripper assemblies 31, 32 outwardly from driven roller 26 against the bias of coiled springs 44, 45, respectively, which, in turn, normally hold the assemblies inward towards driven roller 26.

Since envelope 20*a* is being driven through frictional contact on one side with driven roller 26 and since both belts on the stripper assemblies will be in direct contact with the other side of envelope 20, the driving force on envelope 20*a* and the friction therebetween will be sufficient to rotate both of the belts (i.e. stripper rollers) to thereby allow the envelope to pass on to transport 14 which, in turn, continues the envelope on to its designation. An independent shock absorber or dash pot 49, 50 is provided for assemblies 31, 32, respectively, to reduce the "bounce" experienced when an envelope comes into contact the respective assembly.

Unfortunately, however, there are instances where multi-envelopes 20*b* are pulled off the stack and are fed along with the single letter 20*a* (FIG. 1) through the document feeder. If not compensated for, these multi-feeds can jam the machine which leads to downtime and/or mis-sorts. In the present invention when multi-feeds occur, the "double" 20*b* (FIG. 1) comes into contact with the belt 42 of the shorter-arm stripper assembly 32 first before it contacts belt 41 of the longer-arm stripper assembly 31. Due to preset resistance of stripper roller 32 to rotation, belt 42 stops or significantly slows the advancement of the double 20*b*.

Under ideal conditions, belt 41 would hold multi-fed envelope 20*b* until single envelope 20*a* has passed completely through the pinch between the stripper assemblies and the driven roller 26. Envelope 20*b* would then drop into contact with driven roller 26 to be push thereby on through to the transport 14. This would continue without creating jamming of the document feeder. However, due to differently sizes and/or thickness of envelopes 20, there may instances where the friction between multi-fed envelopes is sufficient to drive the double 20*b* through the first pinch (i.e. between shorter-arm assembly 32 and driven roller 26). If this occurs, the double will be slowed down by the short-arm assembly 32 before it comes into contact with the longer-arm stripper assembly 31. Stripper assembly 31 provides additional resistance against envelope 20*b* thereby preventing its passage through the pinch at that point and holding it until the primary envelope 20*a* has passed through the pinch and onto transport 14.

As pointed out above, by having one of the arms longer than the other on the respective stripper assemblies, a multi-fed envelope is slowed down by the short-arm assembly before it contacts the longer-arm assembly, thereby resulting in better "stripping" of potential multi-feeds. Also, by providing independent dash-pots 49, 50 for assemblies 31, 32, respectively, the "bounce" which occurs when an envelope contacts a respective stripper assembly is off-set thereby providing more contact with a multi-feed envelope at any one time; i.e. when a multi-feed envelope contacts and "bounces" the long-arm assembly 32, the short-arm assembly 31 is in contact with the envelope.

What is claimed is:

1. A singulator for feeding single documents from a stack of documents, said singulator comprising:

a pick-off means for picking off a single document from said stack of documents; and stripper means for engaging any additional document removed from said stack with said single document, said stripper means comprising:

a first stripper assembly and a second stripper assembly mounted one over the other and substantially parallel to each other for independent rotation about a common pivot point; said first stripper assembly comprising:

a first arm having a first end rotatably mounted at said common pivot point and having means at a second end for engaging and restricting further movement of said additional document with respect to said single document;

and wherein said second stripper assembly comprises:

a second arm having a first end rotatably mounted at said common point and having means at a second end for further engaging and restricting further movement of said additional document with respect to said single document wherein said first arm is of a shorter length than that of said second arm whereby said first stripper assembly will engage said additional document before said second stripper assembly engages said additional document.

2. The singulator of claim 1 wherein said first stripper assembly further comprises:

a first idler pulley rotatably mounted on a common shaft with said first end of said first arm at said common pivot point whereby said first idler pulley will rotate independently of said first arm; and wherein said means for engaging said additional document comprises:

a first stripper roller rotatably mounted on said second end of said first arm; and a first continuous belt extending between said first idler pulley and said first stripper roller, said belt adapted to engage said additional document at said second end of said first arm;

and wherein said second stripper assembly further comprises:

a second idler pulley rotatably mounted on a common shaft with said second end of said second arm at said common pivot point whereby said second idler pulley will rotate independently of said second arm; and wherein said means for engaging said additional document comprises:

a second stripper roller rotatably mounted on said second end of said second arm; and a second continuous belt extending between said second idler pulley and said second stripper rollers said second belt adapted to engage said additional document at the second end of said second arm.

3. The singulator of claim 2 wherein said second stripper assembly is positioned above said first stripper assembly.

4. The singulator of claim 2 including:

means for biasing said first stripper assembly towards said additional document; and means for biasing said second stripper assembly towards said additional document.

5. The singulator of claim 4 including:

a first dampening means for dampening movement of said first stripper assembly away from said additional document; and a second dampening means for dampening movement of said second stripper assembly away from said additional document.

6. The singulator of claim 5 wherein said first dampening means comprises:

a first dash-pot; and wherein said second dampening means comprises:

a second dash-pot.

7. A document feeder for a document processing machine, said feed comprising:

a deck having a magazine thereon; said magazine adapted to receive a stack of documents;

a pick-off means for picking off documents one at a time from said stack of documents, said pick-off means comprising:

a pick-off roller for engaging the first document of said stack of documents; and means for driving said pick-off roller in a forward direction to engage said first document and move said first document towards a transport; and stripper means for engaging any additional document removed with said first document to prevent further movement of said additional document, said stripper means comprising:

a first stripper assembly and a second stripper assembly mounted one over the other and substantially parallel to each other for independent rotation about a common vertical pivot point on said deck; said first stripper assembly comprising:

a first arm having a first end rotatably mounted at said common pivot point on said deck and having means at a second end for engaging and restricting further movement of said additional document with respect to said single document;

and wherein said second stripper assembly comprises:

a second arm having a first end rotatably mounted at said common point on said deck and having means at a second end for further engaging and restricting further movement of said additional document with respect to said single document wherein said first arm is of a shorter length than that of said second arm whereby said first stripper assembly will engage said additional document before said second stripper assembly engages said additional document.

8. The document feeder of claim 7 wherein said first stripper assembly further comprises:

a first idler pulley rotatably mounted on a common shaft with said first end of said first arm at said common pivot point on said deck whereby said first idler pulley will rotate independently of said first arm; and wherein said means for engaging said additional document comprises:

a first stripper roller rotatably mounted on said second end of said first arm; and a first continuous belt extending between said first idler pulley and said first stripper roller, said belt adapted to engage said additional document at said second end of said first arm;

and wherein said second stripper assembly further comprises:

a second idler pulley rotatably mounted on a common shaft with said second end of said second arm at said common pivot point on said deck whereby said second idler pulley will rotate independently of said second arm; and wherein said means for engaging said additional document comprises:

a second stripper roller rotatably mounted on said second end of said second arm; and a second continuous belt extending between said second idler pulley and said second stripper roller, said second belt adapted to engage said additional document at the second end of said second arm.

9. The document feeder of claim 8 wherein said second arm is from about ⅛ inch to about ¾ inch longer than said first arm.

10. The document feeder of claim 8 wherein said second arm is from about ⅛ inch to about ¼ inch longer than said first arm.

11. The document feeder of claim 8 wherein said second stripper assembly is positioned above said first stripper assembly.

12. The document feeder of claim 11 including:

means for biasing said first stripper assembly towards said additional document; and means for biasing said second stripper assembly towards said additional document.

13. The document feeder of claim 12 wherein said means for biasing said first stripper assembly comprises:

a coiled spring connected at one end to said deck and at its other end to said first arm wherein rotation of said first stripper assembly will extend said spring; and wherein said means for biasing said second stripper assembly comprises:

a coiled spring connected at one end to said deck and at its other end to said second arm wherein rotation of said second stripper assembly about said common pivot point will extend said spring.

14. The document feeder of claim 13 including:

a first dampening means for dampening the movement of said first stripper assembly as it moves away from said additional document; and a second dampening means for dampening the movement of said second stripper assembly as it away from said additional document.

15. The document feeder of claim 14 wherein said first dampening means comprises:

a first dash-pot connected at one end to said deck and at its other end to said second end of said first arm;

and wherein said second dampening means comprises:

a second dash-pot connected at one end to said deck and at its other end to said second end of said second arm.

* * * * *